US009328492B2

(12) United States Patent
Cohen

(10) Patent No.: US 9,328,492 B2
(45) Date of Patent: May 3, 2016

(54) PLUNGER AND EVAPORATIVE BASE

(71) Applicant: Casabella Holdings, LLC, Congers, NY (US)

(72) Inventor: Elliot Cohen, Monmouth Junction, NJ (US)

(73) Assignee: CASABELLA HOLDINGS, LLC, Congers, NY (US)

( * ) Notice: Subject to any disclaimer, the term of this patent is extended or adjusted under 35 U.S.C. 154(b) by 652 days.

(21) Appl. No.: 13/730,043

(22) Filed: Dec. 28, 2012

(65) Prior Publication Data

US 2014/0182052 A1 Jul. 3, 2014

(51) Int. Cl.
*E03C 1/308* (2006.01)
*E03D 9/00* (2006.01)

(52) U.S. Cl.
CPC . *E03C 1/308* (2013.01); *E03D 9/00* (2013.01); *Y10T 137/5762* (2015.04)

(58) Field of Classification Search
CPC ..... E03C 1/308; Y10T 137/5762; E03D 9/00; A47K 17/00
USPC ..... 4/255.01–255.12
See application file for complete search history.

(56) References Cited

U.S. PATENT DOCUMENTS

| | | | | |
|---|---|---|---|---|
| 3,336,604 | A * | 8/1967 | Lacey | A47K 11/10 4/255.11 |
| D383,935 | S | 9/1997 | Zawalsky | |
| 6,038,709 | A | 3/2000 | Kent | |
| 6,647,567 | B1 * | 11/2003 | Baldwin et al. | 4/661 |
| 6,719,134 | B2 | 4/2004 | Phillips | |
| 6,804,839 | B1 * | 10/2004 | McMaster | 4/255.11 |
| 7,017,197 | B1 | 3/2006 | Williams | |
| 7,328,793 | B2 | 2/2008 | Leaphart | |
| 7,465,942 | B2 * | 12/2008 | Holden | A47K 17/00 206/349 |
| D621,190 | S | 8/2010 | Yoo | |
| 7,806,256 | B2 | 10/2010 | Wildauer | |
| D630,034 | S | 1/2011 | Raven | |
| 7,861,858 | B2 | 1/2011 | Wang | |
| 7,861,859 | B2 * | 1/2011 | Reynolds et al. | 206/349 |
| 7,908,681 | B2 | 3/2011 | Nguyen | |
| 2002/0100705 | A1 | 8/2002 | Phillips | |
| 2003/0226777 | A1 | 12/2003 | Benson | |
| 2006/0037878 | A1 * | 2/2006 | Brown et al. | 206/361 |
| 2006/0213792 | A1 | 9/2006 | Nguyen | |
| 2010/0084292 | A1 | 4/2010 | Wildauer | |
| 2010/0313345 | A1 * | 12/2010 | Stein | 4/255.11 |
| 2012/0012136 | A1 | 1/2012 | Nguyen | |

FOREIGN PATENT DOCUMENTS

| | | |
|---|---|---|
| EP | 0233961 | 9/1987 |

* cited by examiner

*Primary Examiner* — Paul R Durand
*Assistant Examiner* — William R Klotz
(74) *Attorney, Agent, or Firm* — Curtis, Mallet-Prevost, Colt & Mosle, LLP

(57) ABSTRACT

A plunger with evaporative base is disclosed where the evaporative base has a standoff joined to a drainage bottom and a stump and stump channel arrangement for keeping the plunger suspended slightly above the drainage bottom. A plunger is disclosed that mates with the evaporative base and has a plunger bell standoff that mates with the evaporative base standoff to further keep the plunger suspended slightly above the drainage bottom. The outer perimeter of the bell of the plunger is slightly smaller than the inner diameter of the evaporative base body to allow for air circulation between the plunger bell and the evaporative base. Good air circulation and drying promotes cleanliness and reduces the incidence of mold, mildew and bacteria on the plunger and base.

10 Claims, 12 Drawing Sheets

PLUNGER AND EVAPORATIVE BASE

BACKGROUND OF THE INVENTION

1. Field of the Invention

This invention relates generally to plumbing tools, and more specifically to a plunger and an evaporative base.

2. Description of Related Art

Toilet plungers have existed in various forms since the advent of indoor plumbing and modern day water closets (toilets). It is difficult to determine the date and inventor of the first toilet plunger. Toilet plungers work on a principle similar to that of the suction cup, an invention of the 1850's that paralleled the proliferation of synthetic rubber. A toilet plunger is an extremely useful tool that has saved countless hours of frustration, labor, and potentially damaging and disgusting situations. Over the years, toilet plungers have evolved into two general forms, those with a generally flat suction cup base and those with a protruding funnel shape originating from the suction cup base. While toilet plungers are used primarily for removing blockage in a sewage pipe, over the years there have been other note worthy applications including that by early jazz musicians to modify the sound of wind instruments such as trumpets and trombones. Such uses, however, while unconventional, require that the plunger be clean and dry.

After using a plunger for it's intended purpose, it is important for overall cleanliness and hygiene to ensure that the plunger is not only clean, but that it dries thoroughly to prevent the growth of bacteria and other such undesirable organisms such as mold and mildew. This is particularly important in the underside of the plunger bell or suction cup, where moisture and dirt are often retained. Often one will put the recently used plunger in the shower or sink until it dries. This is inconvenient, and is a detriment to the use of the shower or sink. There have been attempts at creating a plunger caddy or holder that sits on the floor and retains the plunger so that water does not drain from the plunger onto the floor. While the goal of such holders is beneficial, the plunger and related holder will still retain water, creating an unclean situation.

What is needed is a plunger and base that retains the plunger, prevents plunger water from draining onto the floor, and promotes evaporation and airflow between the plunger and the base.

It is thus an object of the present invention to provide a plunger and base where the plunger sits slightly above the base to promote evaporation of residual water. It is another object of the present invention to provide a plunger and base where there is a small gap between the plunger bell and the base to promote evaporation and airflow. It is yet another object of the present invention to provide a plunger and base were there are drainage features on the base to promote removal and evaporation of residual water.

These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a plunger and evaporative base comprising a plunger comprising a handle having a male threaded end; a plunger bell comprising a flare, a plunger bell standoff located inside the plunger bell, a bell funnel, and a threaded fitting; the threaded fitting of the plunger bell being coupled to the male threaded end of the handle; an evaporative base for receiving the plunger, the evaporative base comprising a generally cylindrical body having an inner volume; a drainage bottom joined with the generally cylindrical body; a standoff comprising a base and joined with the drainage bottom at the base of the standoff; a bell receiver formed as a space between the inner volume of the generally cylindrical body and the standoff; at least one stump joined with the drainage bottom; and at least one stump channel joined with the first stump.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
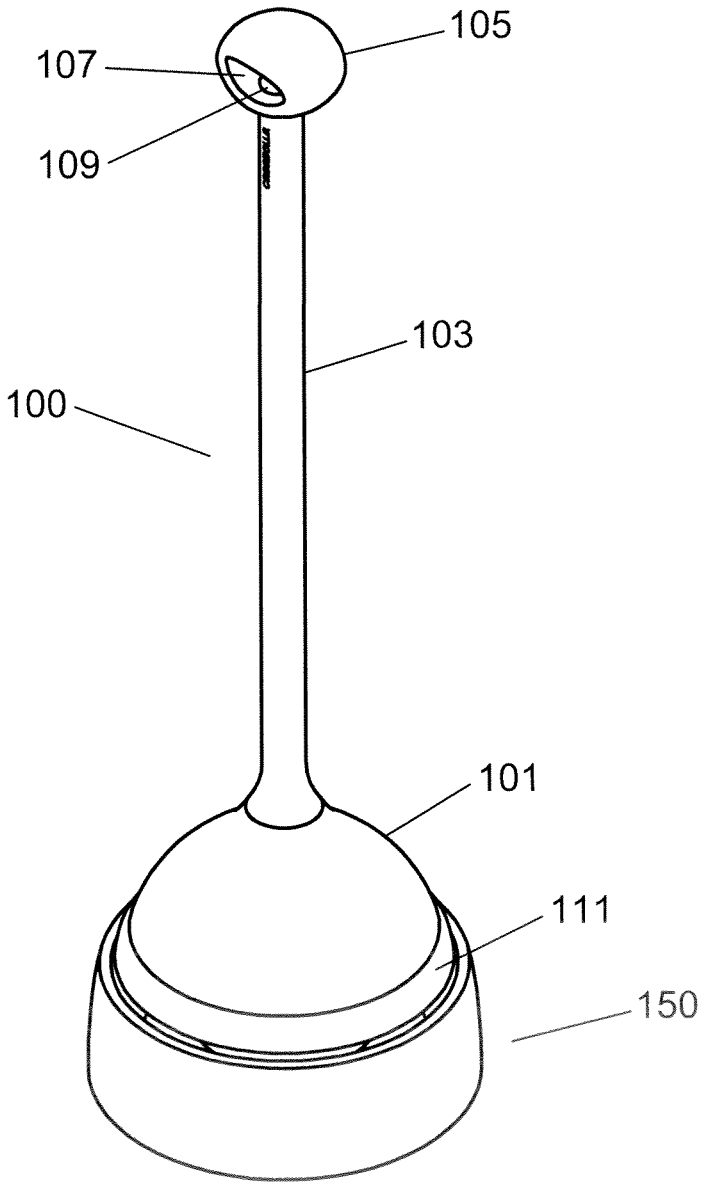
FIG. 1 is a perspective view of a plunger and evaporative base.

The attached figures depict various views of the Plunger and Evaporative Base in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

A Plunger and Evaporative Base is described and depicted by way of this specification and the attached drawings. For a general understanding of the present invention, reference is made to the drawings. In the drawings, like reference numerals have been used throughout to designate identical elements.

The Plunger and Evaporative Base provide a smooth and aesthetically pleasing appearance with the look of a single uninterrupted entity, thus providing for desirable aesthetic properties. In addition, the Evaporative Base acts as a cover and stand for the in Plunger from the inside rather than casing the outside of the plunger bell. The novel structure of the Evaporative Base in combination with the Plunger also provide for improved airflow and drying of the Plunger while resting on the Evaporative Base. This is important to prevent the growth of mold, mildew, and bacteria that would otherwise create odors and non-hygienic conditions.

Figure 18:
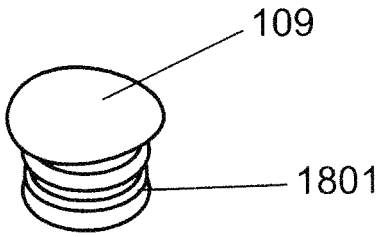
FIG. 18 is a perspective view of a handle insert.

FIG. 1 is a perspective view of the Plunger and Evaporative Base where the plunger 100 can be seen resting on the evaporative base 150. The plunger 100, which will be further described later in this specification, has a bell 101 that is resilient and deformable to allow for the creation of pressure while in use. The bell 101 made be made from, for example, rubber. The bell 101 also has a flare 111 that is a raised area around the perimeter of the bell 101 that may flare or be positioned outward from the bell 101. In some embodiments of the present invention, the flare 111 may also be of a thickness greater than the thickness of the bell 101 to provide for improved performance and deformability of the bell 101. The bell 101 may be made by a process such as, for example, rubber casting. Attached to the bell 101 is a handle 103. The handle 103 may be made from a plastic such as, for example. Polypropylene, or from a wood or a metal. The handle 103 may be made by injection molding, blow molding, casting, machining, or the like. A handle end 105 can be seen attached to, or molded with, the handle 103. The handle end 105 can be seen as a generally oval shaped end having an opening 107. The handle end 105 also has, in some embodiments of the present invention, a generally concave appearance on either of the opening sides, as can be seen clearly in FIG. 3. In some embodiments of the present invention, the handle 103 is hollow, and may have a handle insert 109 to plug up the opening made by the hollow center of the handle 103. FIG. 18 depicts the handle insert 109. The handle insert 109 is made from a generally soft durometer material such as a thermoplastic rubber to accommodate insertion and retention into the hollow of the handle 103.

Figure 2:
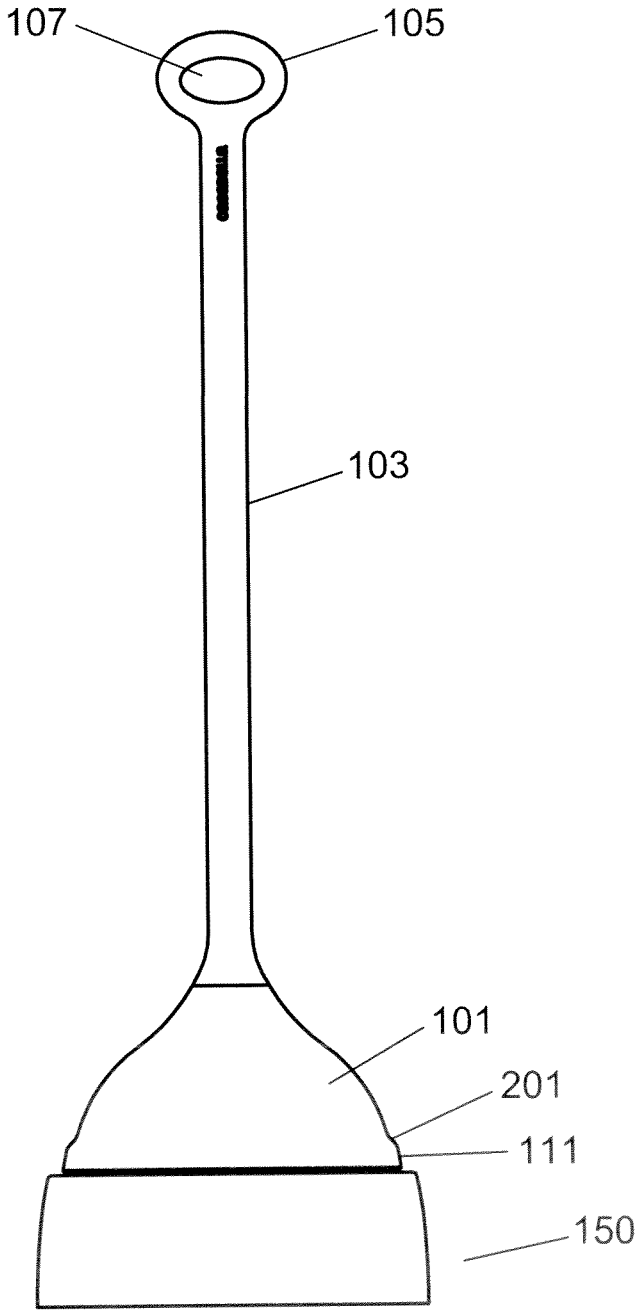
FIG. 2 is a side plan view of the plunger and evaporative base.

FIG. 2 depicts a side plan view of the plunger and evaporative base showing the handle end 105. In addition, the bell 101 may have, in some embodiments of the present invention, a flare 111 may be incorporated into the bell 101. The flare 111 being a raised area around the perimeter of the bell 101 that may flare or be positioned outward from the bell 101. The flare 111 may also have additional features such as, for example, a bevel 201. The bevel 201 may be an angle, a curve, or other similar geometric feature adjacent to and in contact with the flare 111. In some embodiments of the present invention, the flare 111 and the associated bevel 201 may be of a thickness greater than the thickness of the bell 101.

Figure 3:
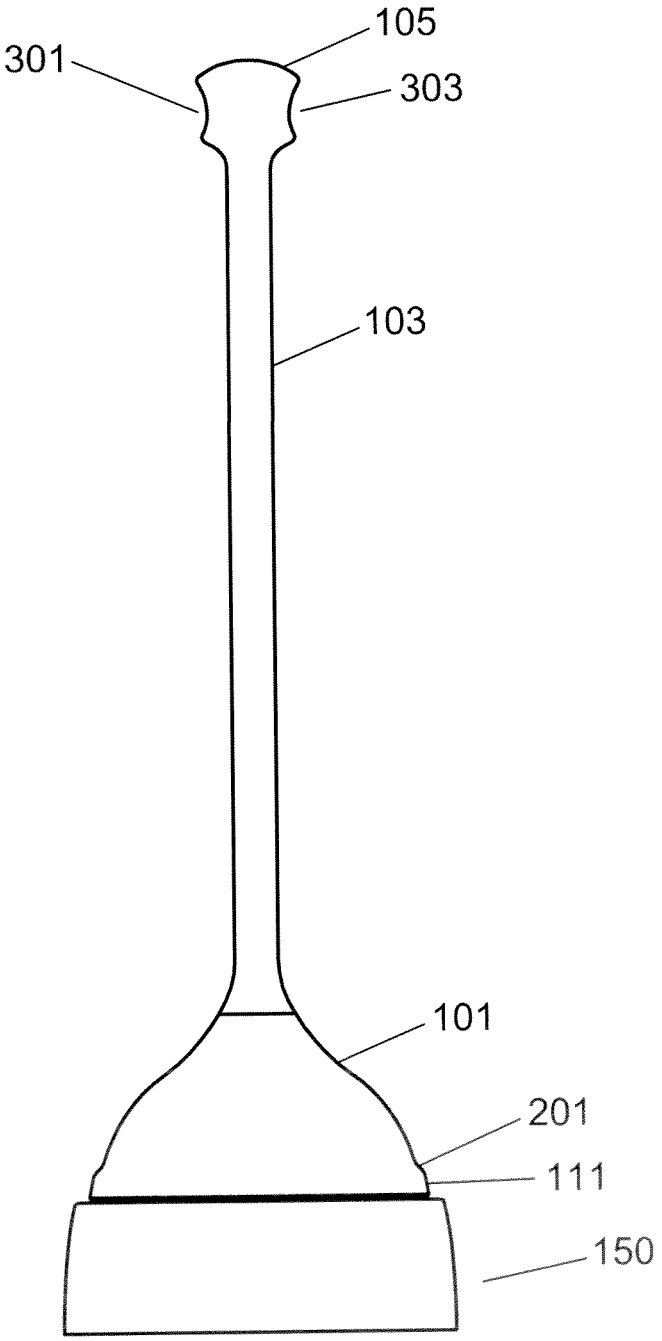
FIG. 3 is a rotated side plan view of the plunger and evaporative base.

FIG. 3 is a rotated side plan view of the plunger and evaporative base. In FIG. 3, the generally concave appearance of the handle end first side 301 and the handle end second side 303 can be seen. The generally concave appearance in FIG. 3 is exemplary only, and may be omitted or changed to another geometric profile without departing from the spirit and broad scope of the present invention as described herein.

Figure 4:
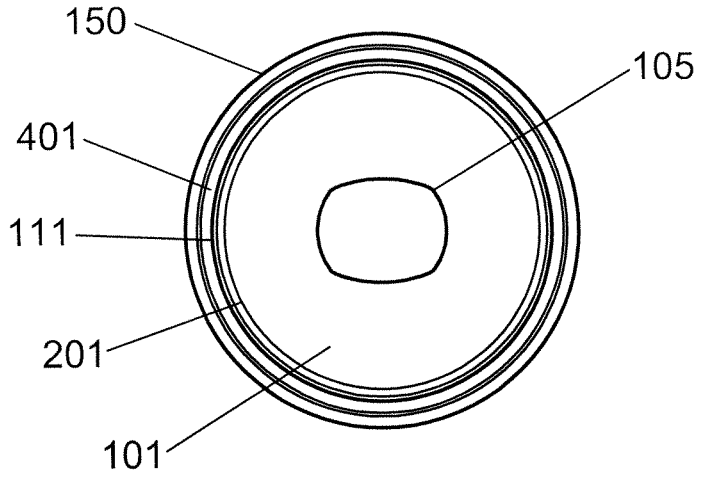
FIG. 4 is a top plan view of the plunger and evaporative base.

For an understanding of the cooperative interaction of the plunger and the evaporative base, FIG. 4 is a top plan view of the plunger and evaporative base. The evaporative base 150 can be seen with a space between the evaporative base 150 and the outer perimeter of the plunger bell 101 as defined in FIG. 4 by the flare 111. Such a space provides for airflow and proper ventilation and subsequent water evaporation from the base and the plunger bell.

Figure 5:
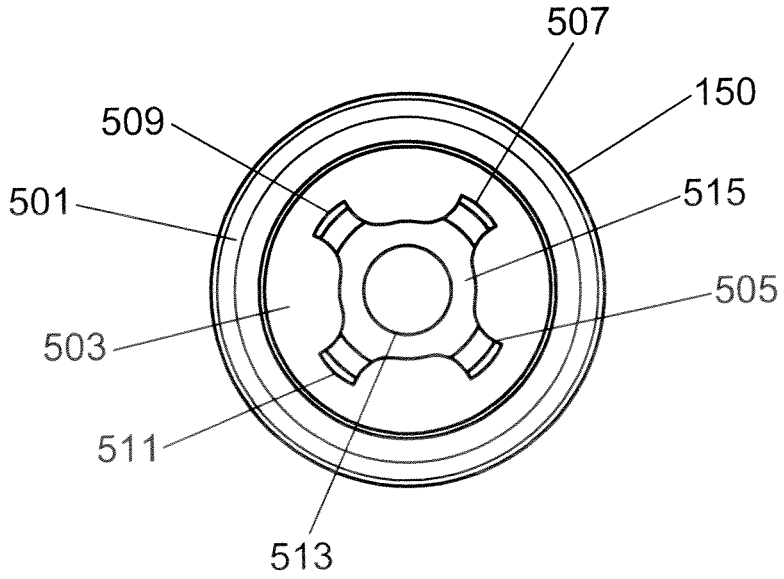
FIG. 5 is a bottom plan view of the plunger and evaporative base.
Figure 6:
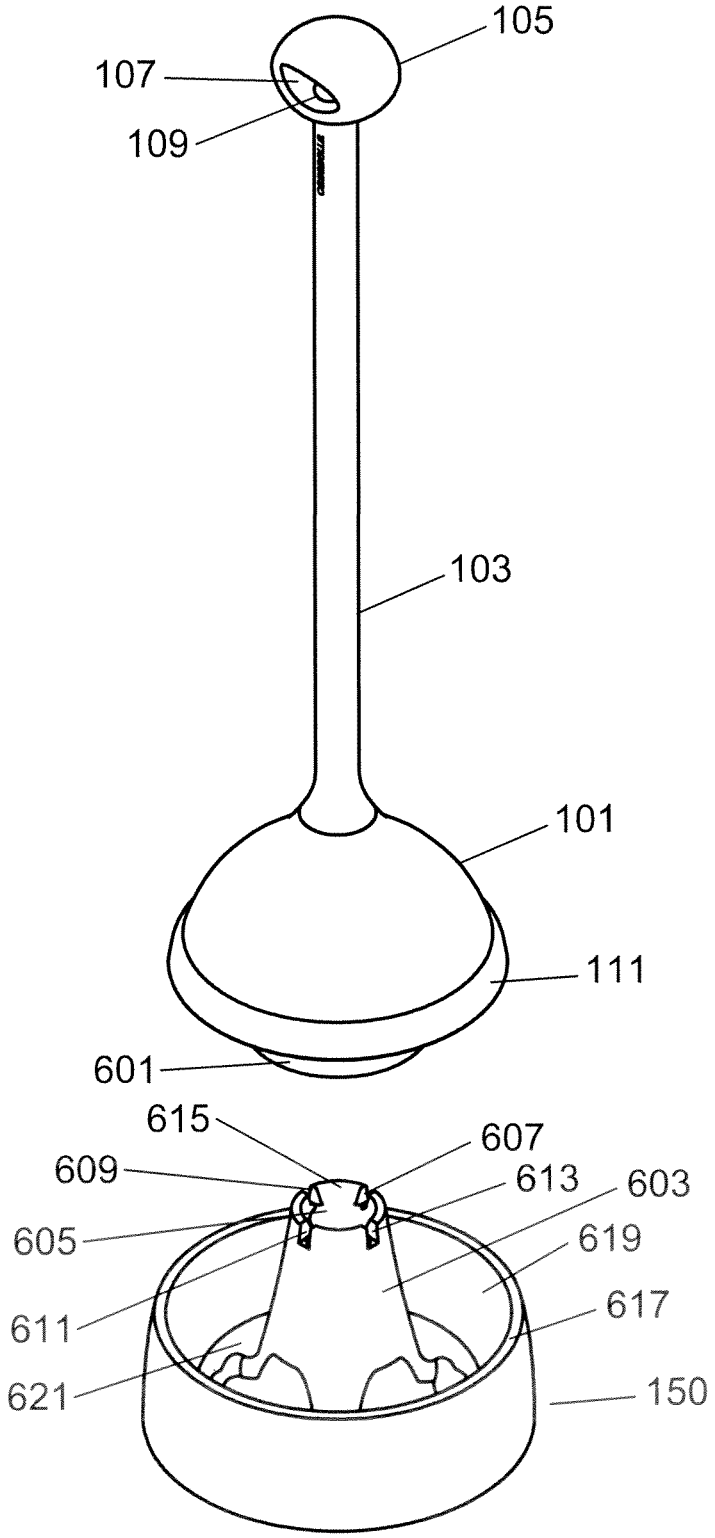
FIG. 6 is an exploded perspective view of the plunger and evaporative base.

FIG. 5 is a bottom plan view of the plunger and evaporative base. Since the outer diameter of the evaporative base is slightly larger than the outer diameter of the plunger, FIG. 5 depicts the underside or bottom plan view of the evaporative base, the plunger being hidden from view. The evaporative base 150 may be made from a plastic such as, for example, polypropylene, and may be injection molded, blow molded, machined, or the like. From the underside, the evaporative base may appear to have a generally V-shaped bottom 501, which from the top side forms a rim, as seen in FIG. 6 (617). The underside of the drainage bottom 503 is a generally flat surface that is the drainage bottom 621 in FIG. 6. There are stump features that can be seen in FIG. 6, the underside of which appear as the underside of first stump 505, the underside of second stump 507, the underside of third stump 509 and the underside of fourth stump 511. The underside of standoff 515 can be seen along with the underside of standoff depression 513. As the standoff is an outwardly protruding feature, the underside of the standoff is thus inwardly protruding, and in some embodiments of the present invention, hollow.

Figure 7:
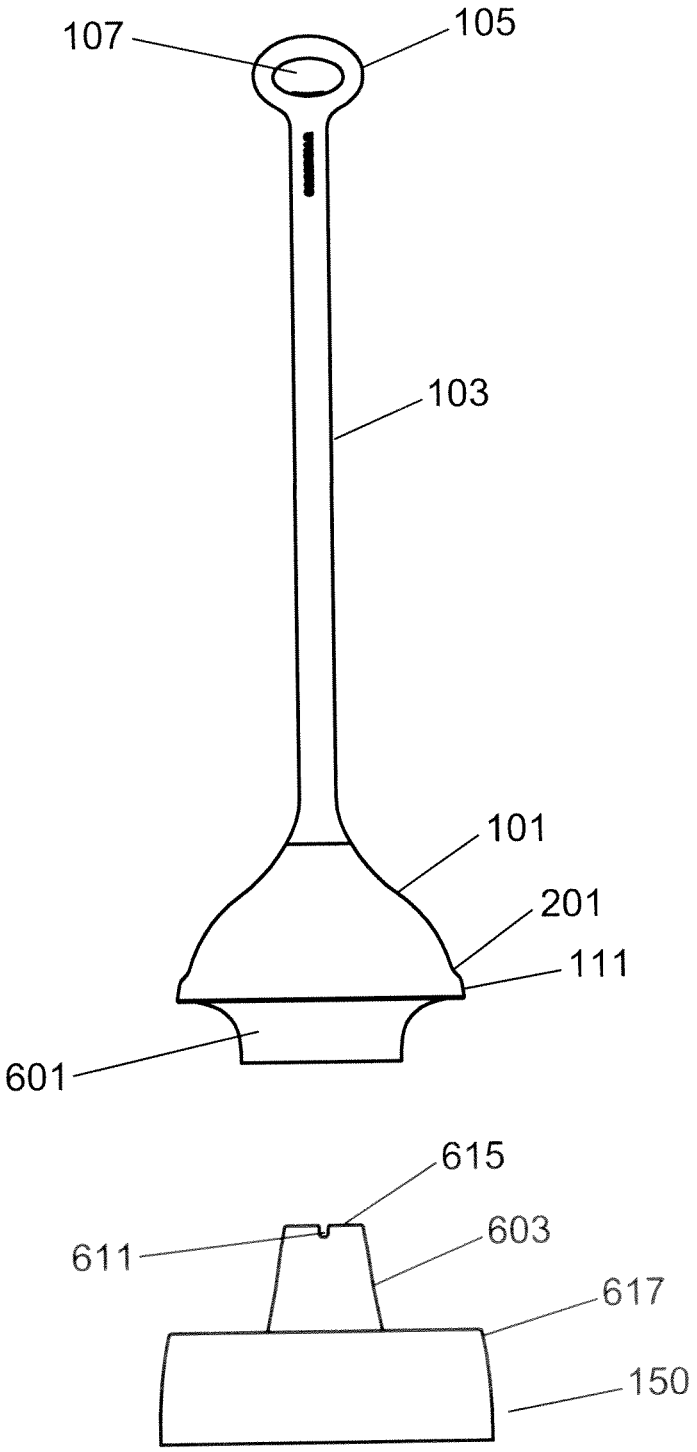
FIG. 7 is an exploded side plan view of the plunger and evaporative base.

FIG. 6 is an exploded perspective view of the plunger and evaporative base that clearly illustrates the cooperative interaction of the plunger and the evaporative base. The plunger bell 101 may, in some embodiments of the present invention, have a bell funnel 601 that interacts with the evaporative base 150 and also, in use, provides a more directed thrust of water to dislodge obstructions from drain pipes. The bell funnel 601 may be molded with the plunger bell 101 and may be made from the same material as the plunger bell 101. The evaporative base 150 has a standoff 603 comprising a base that is joined with the drainage bottom 621 at the base of the standoff. The standoff 603 may, in some embodiments of the present invention, be shaped as a truncated cone. The standoff 603 and related features of the standoff 603 may be made from a plastic, and may be molded or formed with the evaporative base 150. The standoff 603 may, in some embodiments of the present invention, have a standoff depression 605 and a drainage crown 615. The drainage crown 615 is a raised area around the perimeter of the top of the standoff that may, in some embodiments of the present invention, comprise at least one drainage cut. In the example depicted by way of FIG. 6, a first drainage cut 607, a second drainage cut 609, a third drainage cut 611, and a fourth drainage cut 613 are shown. While the drainage cuts are depicted as generally rectangular, other shapes may also be employed, for example, triangular cuts, oval or circular cuts, and the like. A rim 617 can be seen that is made from at least one wall of the evaporative base. In one example, the rim 617 is made from an outer wall and an inner wall of the evaporative base. While the evaporative base 150 can be considered to have a generally cylindrical body, the outer wall and the inner wall of the evaporative base may have a slight angle or curvature. This angle or curvature of the outer wall and the inner wall may be independent of one another in some embodiments of the present invention. A bell receiver 619 is formed as a space between the inner volume of the generally cylindrical body of the evaporative base and the standoff 603. The purpose of the bell receiver 619 is to accommodate and retain the plunger bell 101. A drainage bottom 621 can also be seen that is a generally flat surface upon which water will sit and evaporate once drained from the plunger. The drainage bottom 621 also has at least one stump to facilitate drainage of the plunger, as will be more thoroughly described by way of FIG. 8. For clarity, FIG. 7 is an exploded side plan view of the plunger and evaporative base.

Figure 8:
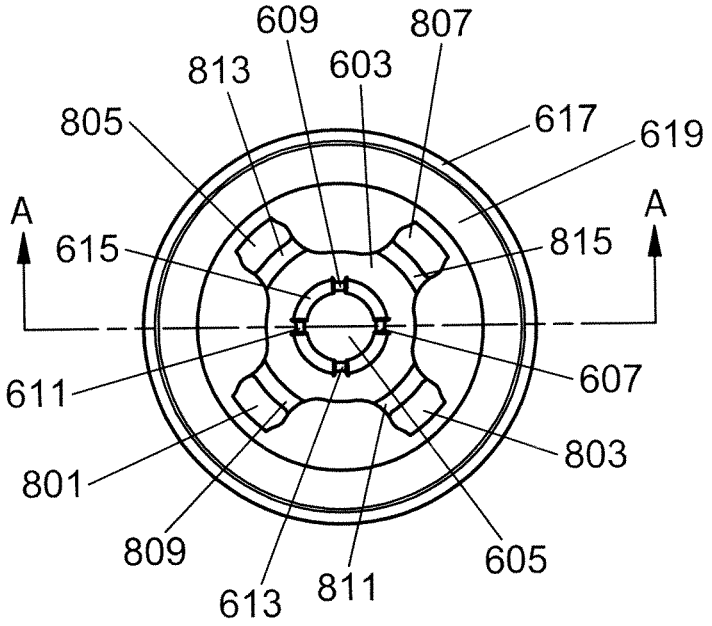
FIG. 8 is a top plan view of the evaporative base only.

Turning now to FIG. 8, a top plan view of the evaporative base is illustrated. There are drainage features that are depicted. For example, the standoff depression 605 and related drainage cuts can be seen. The standoff depression 605 interacts with and retains the plunger (not shown in FIG. 8). At the base of the standoff 603 are four stumps—a first stump 801, a second stump 803, a third stump 805 and a fourth stump 807. In one embodiment of the present invention, the stumps are molded with the evaporative base 150. In some embodiments of the present invention there may be fewer or more stumps than that depicted in FIG. 8. Each stump is a raised feature that has a channel or depressed area for drainage of water and retention of the plunger by way of confinement of a plunger edge such as the edge or perimeter of the bell funnel of the plunger. In the example depicted in FIG. 8, a first stump channel 809 corresponds to the first stump 801, a second stump channel 811 corresponds to the second stump 803, a third stump channel 813 corresponds to the third stump 805, and a fourth stump channel 815 corresponds to a fourth stump 807. In one embodiment of the present invention, each stump is connected or attached to the base of the standoff. The stumps may be rectangular, circular, oval, square, or of other geometries. A stump may, for example, be of a generally rectangular shape with a channel or low area adjacent to the standoff and a higher or raised area away from the standoff. The channel may be curved, rectangular, triangular, or the like. The raised area of the stump may be curved, rectangular, triangular, or the like. In one embodiment of the present invention, the width of the stump channel is approximately the same width as that of the raised area of the stump. In one embodiment of the present invention, the stump meets the base of the standoff at a generally right angle where the right angle may, in some embodiments of the present invention, have a radius of curvature.

Figure 9:
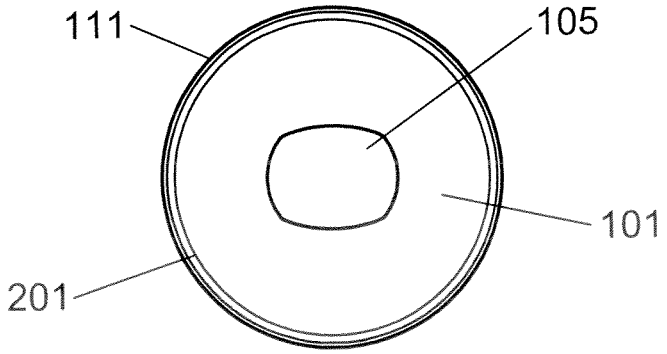
FIG. 9 is a top plan view of the plunger only.

FIG. 9 is a top plan view of the plunger only where the plunger bell 101 can be seen along with the handle end 105, flare 111 and bevel 201.

Figure 10:
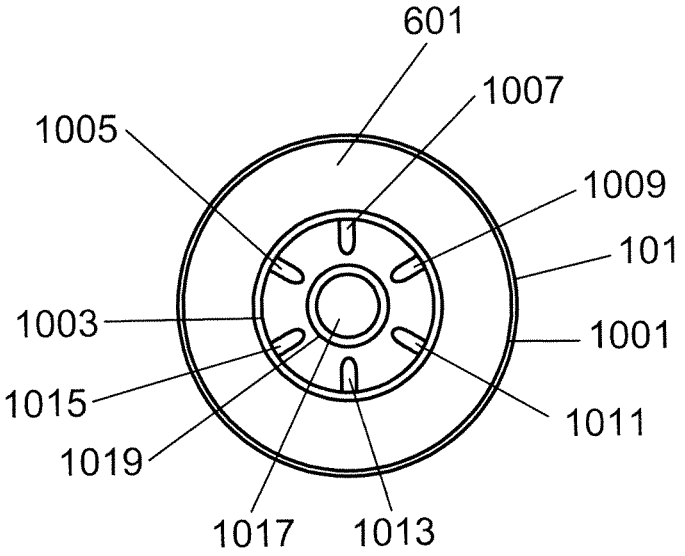
FIG. 10 is a bottom plan view of the plunger only.

Now turning to the construction of the plunger bell 101 where FIG. 10 is a bottom plan view of the plunger only showing the inside of the plunger bell and related features that may be present in some embodiments of the present invention. The plunger bell 101 may be of a form similar to that of a suction cup. The flare of the plunger bell creates a thicker perimeter area that creates a plunger bell flare circumferential edge where the circumferential edge of the plunger bell is thicker than the remainder of the plunger bell so that, for example the plunger bell circumferential edge does not deform in use in relation to the rest of the plunger bell that should in fact deform in use. The plunger bell 101, having a bell funnel in some embodiments of the present invention, also has a plunger bell funnel circumferential edge 1003 that engages with a plumbing opening such as the drain of a toilet or the like, creating a tight seal to allow water to be pushed by way of the plunger into the opening that is obstructed. The plunger may also, in some embodiments of the present invention, have ribs to provide improved structural deformation and shape retention of the plunger bell during use. Shown in FIG. 10 are a set of six ribs, a first rib 1005, a second rib 1007, a third rib 1009, a fourth rib 1011, a fifth rib 1013, and a sixth rib 1015. There may be more or less than six ribs in various embodiments of the present invention. The ribs are joined to the inner surface of the plunger bell 101. Also illustrated in FIG. 10 is a plunger bell standoff 1017 that is formed of rubber or similar material in the same way that all of the plunger bell features are, and protrudes into the inside of the plunger bell and may, in some embodiments of the present invention, be the result of the threaded plunger bell fitting shown in FIG. 15. The plunger bell standoff 1017 engages with the standoff depression 605 as seen in FIG. 6 and serves to retain and space the plunger on the evaporative base. In some embodiments of the present invention, a plunger bell standoff circumferential edge 1019 may also be present that protrudes from the perimeter or circumferential edge of the plunger bell standoff.

Figure 11:
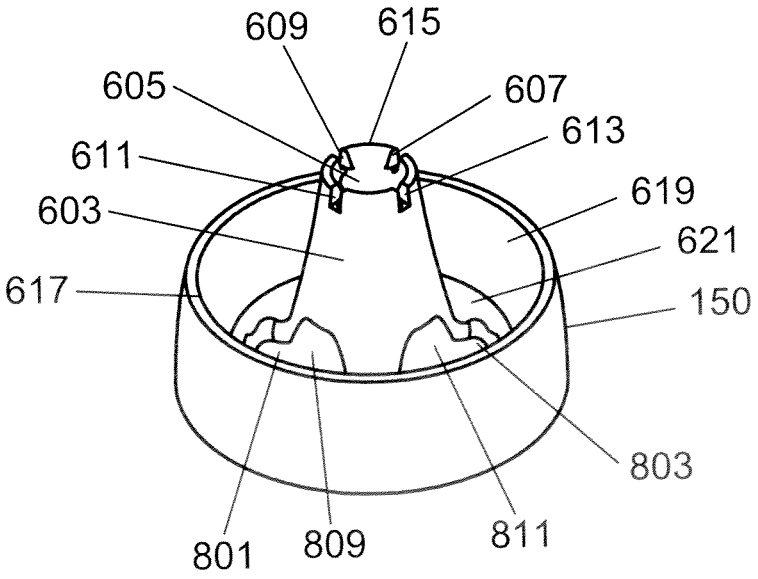
FIG. 11 is a perspective view of the evaporative base only.
Figure 12:
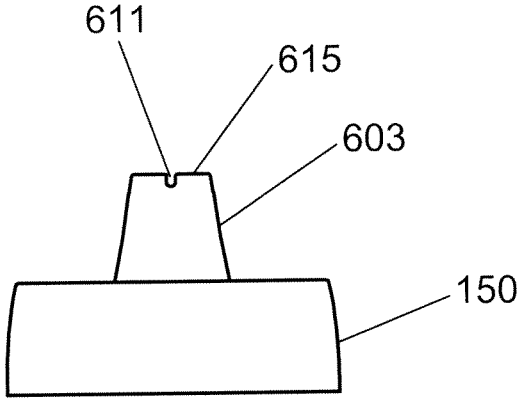
FIG. 12 is a side plan view of the evaporative base only.
Figure 13:
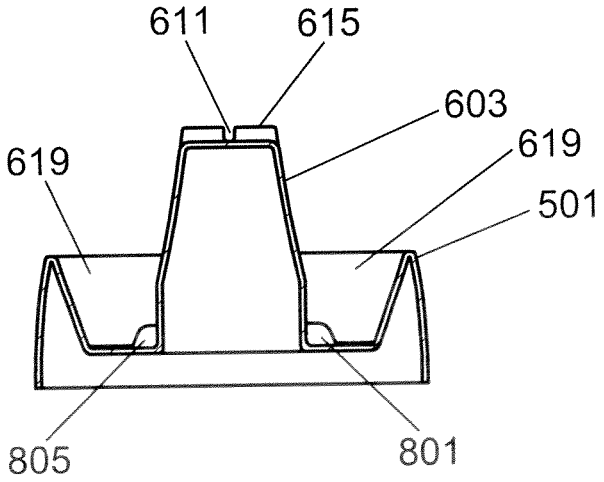
FIG. 13 is a cutaway view of the evaporative base cut along line A-A of FIG. 8.

FIG. 11 is a perspective view of the evaporative base only showing the features that have been heretofore described. The cooperative elements of the plunger bell standoff 1017 (see FIG. 10) and the standoff depression 605, the stump and channel arrangement and the plunger bell funnel circumferential edge 1003 (see FIG. 10), and the related drainage and spacing features, can be seen clearly in FIG. 11. Such interaction keeps the plunger from contacting the drainage bottom of the evaporative base. Further, in some embodiments of the present invention, the outer perimeter of the plunger bell is slightly smaller than the inner perimeter of the evaporative base body to allow for air circulation between the plunger bell and the evaporative base. FIG. 12 is a side plan view of the evaporative base only. FIG. 13 is a cutaway view of the evaporative base cut along line A-A of FIG. 8 showing the first stump 801 and the second stump 803 in partial view behind the standoff 603.

Figure 14:
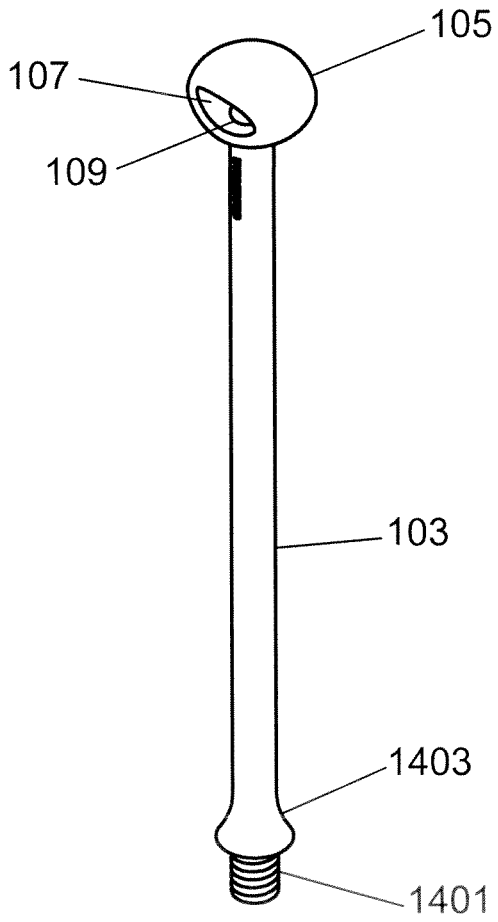
FIG. 14 is a perspective view of a handle of the plunger.

FIG. 14 is a perspective view of a handle 103 of the plunger. The handle 103 may be made from a plastic such as, for example, Polypropylene, or from a wood or a metal. The handle 103 may be made by injection molding, blow molding, casting, machining, or the like. A handle end 105 can be seen attached to, or molded with, the handle 103. The handle end 105 can be seen as a generally oval shaped end having an opening 107. The handle end 105 also has, in some embodiments of the present invention, a generally concave appearance on either of the opening sides, as can be seen clearly in FIG. 3. In some embodiments of the present invention, the handle 103 is hollow, and may have a handle insert 109 to plug up the opening made by the hollow center of the handle 103. FIG. 18 depicts the handle insert 109. The handle insert 109 is made from a generally soft durometer material such as a thermoplastic rubber to accommodate insertion and retention into the hollow of the handle 103. At the end of the handle 103 opposite to that of the handle end 105 is a male threaded end 1401 for mating with the threaded plunger bell fitting of the plunger bell (see FIG. 15). In some embodiments of the present invention, a flared handle skirt 1403 may be employed to mate with the curved form of the plunger bell to create both a stronger connection of handle to bell and also to provide a more aesthetically pleasing form.

Figure 15:
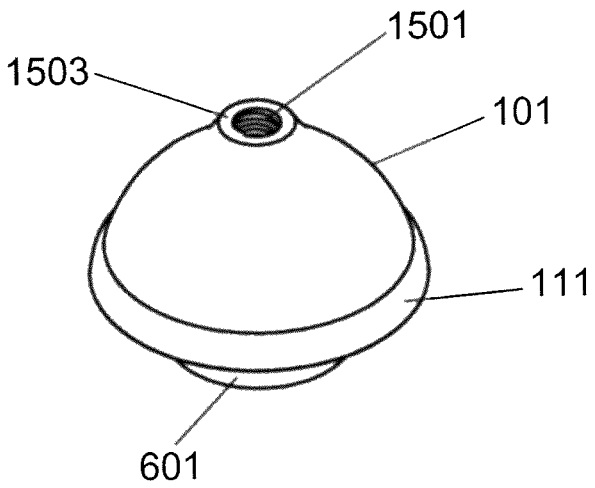
FIG. 15 is a perspective view of a plunger bell.
Figure 16:
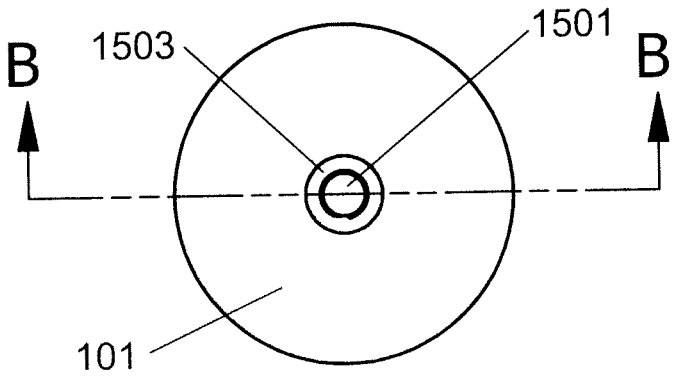
FIG. 16 is a top plan view of a plunger bell.
Figure 17:
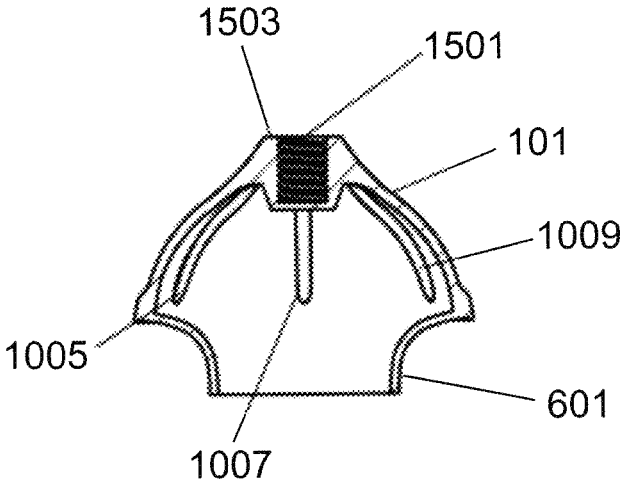
FIG. 17 is a cutaway view of the plunger bell cut along line B-B of FIG. 16.

FIG. 15 is a perspective view of a plunger bell 101 that clearly shows the threaded plunger bell fitting 1501 that mates with the male threaded end of the handle 103. The threaded plunger bell fitting 1501 is molded or otherwise formed with the plunger bell 101. In some embodiments of the present invention, a flat circumferential edge 1503 is formed around the threaded plunges bell fitting 1501 to provide a flat mating surface for the flared handle skirt 1403 depicted in FIG. 14. FIG. 16 is a top plan view of the plunger bell 101 showing in further detail the flat circumferential edge 1503 and the threaded plunger bell fitting 1501. FIG. 17 is a cutaway view of the plunger bell cut along line B-B of FIG. 16 that shows the threaded plunger bell fitting 1501, in this example a female fitting, that mates with the male threaded end 1401 of the handle 103.

Lastly, FIG. 18 is a perspective view of a handle insert 109. The handle insert 109 is made from a generally soft durometer material such as a thermoplastic rubber to accommodate insertion and retention into the hollow of the handle 103. In the example depicted in FIG. 18, handle insert friction ribs 1801 are molded or otherwise formed with the handle insert 109 to facilitate retention of the handle insert 109 into the hollow of the handle 103. Should the handle 103 be made as a solid without a hollow portion, the handle insert 109 may be omitted.

To use the Plunger and Evaporative Base, the plunger is removed from the evaporative base and the bottom or bell funnel of the plunger is placed over the drain opening to be unclogged or unplugged. Such openings include, for example, toilet drain openings, sink drain openings, and the like. The plunger is then pushed downward by the handle, often multiple times. This action forces water down the drain opening and creates water pressure to unseat and move the clog in the drain. Once this plunging has been successfully completed, the wet plunger is then returned to the evaporative base where it will dry and be retained for the next use. The novel details of construction of the Plunger and Evaporative Base being heretofore provided and depicted.

It is, therefore, apparent that there has been provided, in accordance with the various objects of the present invention, a Plunger and Evaporative Base. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. An evaporative base for receiving a plunger, the evaporative base comprising:

a generally cylindrical body having an inner volume;

a drainage bottom joined with the generally cylindrical body;

a standoff comprising a base for engaging with a plunger bell standoff of a plunger protruding centrally outward from the drainage bottom and joined with the drainage bottom at the base of the standoff;

wherein the standoff further comprises a standoff depression at the top of the standoff, a drainage crown comprising a raised area around a perimeter of the top of the standoff, and at least one drainage cut at the perimeter of the top of the standoff for draining water to the drainage bottom;

a bell receiver formed as a space between the inner volume of the generally cylindrical body and the standoff;

a first stump joined with the drainage bottom; and a first stump channel joined with the first stump.

2. The evaporative base of claim 1, wherein the standoff is shaped as a truncated cone.

3. The evaporative base of claim 1, wherein the standoff further comprises four drainage cuts.

4. The evaporative base of claim 1, further comprising a second stump, a third stump and a fourth stump.

5. The evaporative base of claim 4, further comprising a second stump channel, a third stump channel and a fourth stump channel.

6. A plunger and evaporative base comprising:

a plunger comprising a handle having a threaded end;

a plunger bell comprising a flare, a plunger bell standoff having a generally flat horizontal surface for engaging with a standoff of an evaporative base, the plunger bell standoff located inside and to the center of the plunger bell, a bell funnel, and a threaded fitting;

the threaded fitting of the plunger bell being coupled to the male threaded end of the handle;

an evaporative base for receiving the plunger, the evaporative base comprising:

a generally cylindrical body having an inner volume;

a drainage bottom joined with the generally cylindrical body;

a standoff comprising a base for engaging with a plunger bell standoff of a plunger protruding centrally outward from the drainage bottom and joined with the drainage bottom at the base of the standoff;

wherein the standoff further comprises a standoff depression at the top of the standoff, a drainage crown comprising a raised area around a perimeter of the top of the standoff, and at least one drainage cut at the perimeter of the top of the standoff for draining water to the drainage bottom;

a bell receiver formed as a space between the inner volume of the generally cylindrical body and the standoff;

at least one stump joined with the drainage bottom; and at least one stump channel joined with the first stump.

7. The plunger and evaporative base of claim 6, wherein the plunger bell standoff contacts the evaporative base standoff to keep the plunger from contacting the drainage bottom of the evaporative base.

8. The plunger and evaporative base of claim 6, wherein the outer perimeter of the plunger bell is slightly smaller than the inner perimeter of the evaporative base body to allow for air circulation between the plunger bell and the evaporative base.

9. The plunger and evaporative base of claim 6, wherein the standoff of the evaporative base further comprises four drainage cuts.

10. The plunger and evaporative base of claim 6, further comprising a second stump and a second stump channel, a third stump and a third stump channel, and a fourth stump and a fourth stump channel.

* * * * *